United States Patent [19]

Capetti

[11] 3,960,079

[45] June 1, 1976

[54] ROTARY PRINTING PRESS

[75] Inventor: Federico Capetti, Turin, Italy

[73] Assignee: Societa' Nebiolo S.p.A., Turin, Italy

[22] Filed: July 15, 1974

[21] Appl. No.: 488,858

[30] Foreign Application Priority Data

July 25, 1973 Italy ..... 69231/73

[52] U.S. Cl. ..... 101/232; 101/183; 271/270

[51] Int. Cl.[2] ..... B65H 5/10; B65H 5/12

[58] Field of Search ..... 271/270, 277, 247; 101/183, 232, 136, 408, 409, 410

[56] References Cited

UNITED STATES PATENTS

| | | | |
|---|---|---|---|
| 1,837,241 | 12/1931 | Van Buren | 271/270 |
| 2,011,744 | 8/1935 | Wormser | 271/270 |
| 2,027,818 | 1/1936 | Golber | 271/270 X |
| 2,084,783 | 6/1937 | Seybold | 271/270 X |
| 2,127,568 | 8/1938 | Novick | 271/270 X |
| 2,143,514 | 1/1939 | Hackbarth | 271/270 |
| 2,164,549 | 7/1939 | Stephenson | 271/270 |
| 2,170,489 | 8/1939 | Spiess | 271/270 |
| 2,192,916 | 3/1940 | Kaddeland et al. | 271/270 X |
| 2,210,573 | 8/1940 | Eckhard | 271/270 X |
| 2,248,079 | 7/1941 | Harrold et al. | 271/270 X |
| 2,372,783 | 4/1945 | Jacobson | 101/183 X |
| 2,699,333 | 1/1955 | Claybourn et al. | 271/270 |
| 2,841,391 | 7/1958 | Norton | 271/270 X |
| 3,201,115 | 8/1965 | Kury | 271/270 |
| 3,461,798 | 8/1969 | Bulk et al. | 101/234 X |
| 3,596,903 | 8/1971 | Jurny | 271/270 |
| 3,772,990 | 11/1973 | Weisgerber | 101/232 X |
| 3,832,944 | 9/1974 | Koerner et al. | 101/183 X |

*Primary Examiner*—Edgar S. Burr
*Assistant Examiner*—Paul J. Hirsch
*Attorney, Agent, or Firm*—Sughrue, Rothwell, Mion, Zinn & Macpeak

[57] ABSTRACT

A rotary printing press for printing single sheets has a transfer drum for conveying sheets singly from a feeder table to the periphery of a printing drum rotating at a constant velocity. To make up for the lag introduced between the tail end of each sheet and the leading edge of the next following sheet as the latter is picked up from the feeder table, the transfer drum in carrying the sheet to the printing drum accelerates the sheet to a speed greater than the peripheral speed of the printing drum before slowing the sheet down to the peripheral speed of the printing drum prior to transfer of the sheet to the latter.

4 Claims, 10 Drawing Figures

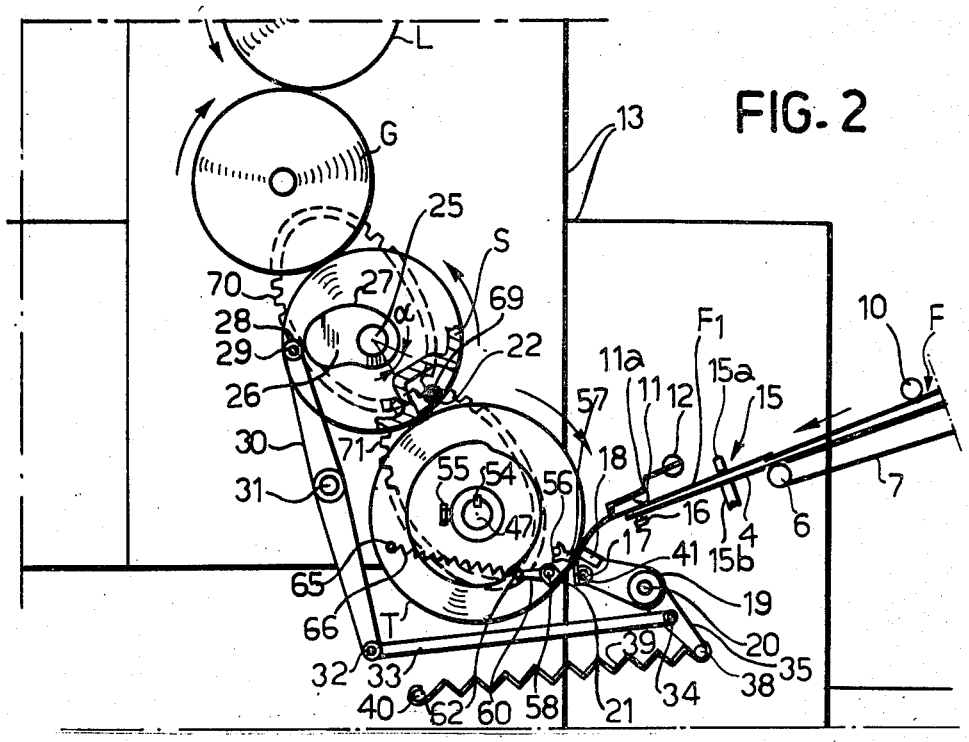
FIG. 2
FIG. 3
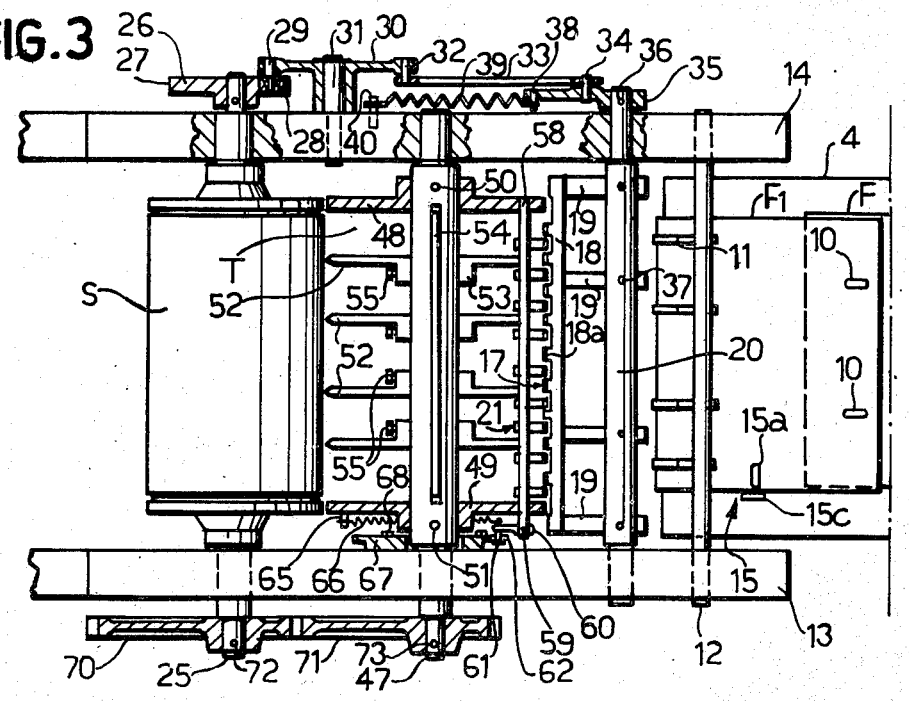

ROTARY PRINTING PRESS

BACKGROUND OF THE INVENTION

The present invention concern rotary printing presses for single sheets, for direct or indirect printing of sheets on one side only or on both sides.

Rotary printing presses are known in which sheets of paper, card or other printable material, withdrawn singly from a pile by means of a feeder, are caused to travel, partly overlapping, along a feeder table by means of belts or like conveyor means, and then stopped so as to be set in register frontally and laterally at the end of their travel upon the feeder table, after a control device has signalled their arrival in the correct position, the setting of the sheets in register being so effected that the sheets are all in the same position in relation to the printing members of the press and, in particular, in relation to the printing cylinder or forme, which is the element which transfers ink on to the sheet according to the graphical signs to be printed.

The printing cylinder receives ink from inking rolls. The sheet, after being checked and set in register upon the feeder table, is gripped by suitable feeder members and moved from the rest condition to the peripheral velocity of the printing cylinder, on which it is deposited to receive a printing of ink therefrom. From the printing cylinder the sheet is delivered to extractor members which convey it to a stack upon a delivery table. It is possible to insert upstream of the delivery table additional printing units arranged to print upon the sheet different graphical patterns by means of respective printing cylinders, the sheet being conveyed from one printing cylinder to the next by means of a series of conveyor rolls.

In present-day presses of this type, the need to make them even faster and more convenient presents problems which, if not new, are nevertheless acute.

More particularly, reduction of the diameter of the printing cylinders for a given maximum format of the sheet to be printed is a goal towards which manufacturers are striving, in view of the considerable advantages to be derived therefrom.

Reducing the diameter of the printing cylinder, in fact, makes it possible, in the first place, to reduce the peripheral speed at which ink is transferred from the inking rolls to the printing cylinder and from the latter to the sheet, and conversely to increase the angular velocity of the cylinder for a given optimal peripheral velocity, and hence increase the output of printed sheets in a given unit of time. Also it will be noted that a reduction of the peripheral velocity of the printing cylinder makes the control of the sheet easier.

In the second place, reduction of the diameter of the printing cylinder allows, especially in large size printing presses, reduction of the weight of the press, and hence of its cost, as well as its overall dimensions, so as to render it easier of access and more convenient.

Moreover, since the movement of inertia of a rotating cylindrical mass is inversely proportional to the square of its radius, reduction of the diameter of the printing cylinder and of the other rotary members the dimensions of which are determined by the diameter of the printing cylinder, such as the members conveying the sheet from the feeder table of the machine to the delivery table, entails a reduction of the related inertial forces of inertia and of the consequent mechanical stresses. This reduction of the inertial forces is an advantage which is the more effective as the maximum angular velocity required of the printing cylinder increases, since it makes it possible to prolong the life of those members which are under the most stress, such as shafts, bushes and, especially, gears. Particularly in offset printing presses the maintainance of the drive gears at peak efficiency is very important in order to achieve perfectly successful printing.

The reduction of the printing cylinder diameter, however, leads, at a given maximum printing format, to an increase in the angular width of the printing arc of the cylinder and a proportional reduction in the non-printing arc which, in hitherto known presses, is linked the stopping time of the sheet on the feeder table.

This stopping time is necessary, in known systems, in order to carry out the following operations on the sheet: detection of regular arrival of the sheets at the registers; front registration of the sheets; lateral registration; gripping of the sheet by the feeder members when the sheet is at rest, and disengagement of the edge of the stationary sheet from the register members.

Since, with systems at present in use, in order to carry out all, or almost all, these operations, with the sheets fed in overlapping relation, it is absolutely necessary that the front edge of the sheet arriving at the registers should be uncovered by the tail portion of the preceding sheet which is going on for printing. The speed of removal of the said tail portion of the preceding sheet therefore takes on great importance.

This speed of removal depends, for a given maximum format of sheet to be printed and for a given diameter of the printing cylinder, upon the distance which the sheet has to travel in passing from the feeder table to the said cylinder, and upon the movement imparted to the sheets by the sheet feeding members.

The types of sheet feeding members known up to the present are confined to withdrawing the sheet, while stationary and already set upon the feeder table and to increasing its speed up to the constant peripheral velocity of the printing cylinder (or of an equivalent intermediate transfer cylinder) without ever exceeding this velocity.

More precisely, up until now, for these purposes the following types of sheet feeding members have been employed:

a. Grippers with rotary drive housing, carried by the printing cylinder and arranged in each rotation to grip the edge of the stationary sheet, carrying it immediately to the peripheral velocity of the said cylinder. This constitutes a very simple system, with only small masses used, but is antiquated and unacceptable since it gives no guarantee as to the precision of print registration, especially if the velocity of the machine is even slightly varied.

b. Lever grippers, consisting of a series of grippers which, carried upon lever arms, grip the stationary sheet when set in register upon the feeder table and carry it quickly to the peripheral velocity of the printing cylinder (or of an intermediate transfer cylinder the peripheral velocity of which is equal to that of the printing cylinder), transfer the sheet to the latter at a tangent and then decelerate to stop at a dead centre position, from which position they return to take up the next sheet.

The circular path of the grippers is tangential to the feeder table and to the printing cylinder (or to the intermediate transfer cylinder) and is disposed mostly above the printing cylinder and the feeder table, but can also be below them, giving rise in this latter case to the so-called "English" feed system.

Lever grippers have the advantage that they are open in the return path and in a position to take up the next sheet ready on the feeder table, but they have the disadvantage of having to pass back, on returning, in correspondence with the printing cylinder only after having passed the end of the sheet of the largest format carried by the press on to printing by the printing cylinder. If the largest format is of considerable dimensions in relation to the diameter of the cylinder, then little time is left to complete the return of the lever grippers on to the feeder table, and their deceleration on arrival at the feeder table is too sudden.

This disadvantage is avoided by movement of the centre of oscillation (for example by means of a pair of eccentric bushes pivoted to the shoulders of the cylinder and driven by a suitable mechanism) so as to detach the lever grippers from the cylinder at the critical moment of their passage, so that they do not intrude into the printing area of the cylinder.

c. Intermittently rotating drum provided with a series of grippers, carried either by a drum or by a series of arms which, up to the transfer of the sheet to the printing cylinder, behave like the lever grippers, but after this continue their circular movement, in the same rotating direction, decelerating at the end of the revolution of the drum to come to a stop at a tangent to the feeder table, for withdrawing the next sheet.

This device has the advantage of not having a reversing movement, and therefore it does not pass back in correspondence with the printing cylinder, as occurs in the case of lever grippers on their return. It has nevertheless the disadvantage of coming down onto the sheet on the feeder table, and if the sheet is already stationary on the table in the position of register, it is necessary to provide some device whereby the gripper shall not disturb the registration of the sheet (for example, the feeder table can be lowered and then raised).

d. Continuously rotating drum. This device has been embodied in two systems, as follows:

In the first system the drum receives, directly, a sheet which has stopped for setting upon the feeder table, whilst still rotating continuously. It carries a turnover group of take-off grippers driven so that this group retracts within the periphery of the drum when the grippers pass over the stationary sheet, and then emerge again at a drive rate such that the peripheral velocity of the drum, combined with the equal and opposite turn-over speed of the gripper group, shall give, at one instant, zero resultant velocity when the grippers take hold of the sheet edge.

In the second "feed rolls" pointing system the sheet is controlled, and is stopped upon the feeder table, against a series of fixed front registers. There then follows the lateral registration of the sheet on the feeder table. Subsequently a group of upper and lower feed rolls speed up the sheet and thrust its front edge against a second series of front registers carried upon a continuously rotating drum. The grippers of the drum take up the sheet thus set and exchange it with the printing cylinder at a tangent position and at equal peripheral velocity.

Acceleration of the sheet can be effected partly by the "feed rolls" and partly by the drum if the latter revolves at a variable velocity, or else entirely by the "feed rolls" if the drum revolves at a peripheral velocity which is constantly equal to that of the printing cylinder; in the latter case the drum becomes an intermediate transfer cylinder, and, if desired, feed-in by the "feed rolls" could be effected directly against the printing cylinder.

Sheet feed by means of "feed rolls" has the advantage of eliminating the considerable masses of the lever grippers, as well as the problems related to their acceleration, but it has the disadvantage of not being suitable for all types of paper, and moreover it causes, in the front edge of the sheet, deformations which in the printing process are amplified towards the tail end, and can badly affect good setting.

All the traditional sheet feed means considered up to now have, in order of diminution of the diameter of the cylinders for a given format of the sheet to be printed, considerable limitations and weak points. On average, the time the sheet is required in practice to remain stationary on the feeder table corresponds to about 90° – 100° of rotation of the printing cylinder.

By the use of various types of devices known as "pre-registers", especially in large format printing presses, the stopping time has been reduced to about 60° of rotation of the printing cylinder, and consequently it has been possible to reduce the diameter of the said cylinder for a given maximum format of paper.

Such known devices consist substantially of a series of frontally aligned locators which move periodically, in correspondence with the arrival of every sheet, in the direction of advantage of the sheet-guide belts. The speed at which the frontal locators move is slightly less, at the beginning, than that of the belts, and decreases progressively so as to facilitate the setting in register, against the said locators, of the front edge of the sheet in its descent. When the sheet comes, with reduced impact velocity, into contact with the main (fixed) registers, its front setting is almost complete, and the stopping time of the sheet is therefore practically reduced to the time of lateral registration and to the time of checking the arrival of the sheet. The disadvantage of known pre-register devices is their complexity. Moreover, in the way such devices have been used up to now, the reduction in the stopping time of the sheet on the feeder table renders the pre-register devices unsuitable for use upon machines with a very high production speed. In fact, in this case, owing to the increased rotational speed, the already low stopping time is further reduced by the lesser time taken to effect each turn of the printing cylinder. Beyond a certain limit of velocity, the stopping time becomes insufficient in the proper sense for carrying out sure end perfect setting of the sheet, inasmuch as the sheet, especially one of large format, no longer has the time to settle itself against the pre-registers.

Also, checking the regular arrival of the sheets at the registers can be impaired by excessive brevity of the stopping time, since, in the event of irregular arrival of a sheet, it is necessary to provide a signal for operating electrical, mechanical, hydraulic or pneumatic servo-controls in sufficient time to prevent printing of the sheet, and to effect, before the printing cycle starts, different sheet delivery operations, including removal of pressure between the cylinders, interruption of the sheet feed, removal of the inking rollers from the printing cylinder, and stopping of the setters on the table.

In order to overcome the disadvantages and shortcomings which conventional sheet feeding systems possess, the most advantageous solution is that of advancing disengagement of the line of registers from the end of the sheet of greatest format which is going to be printed.

Attempts have been made in this direction, with the intention of speeding up the tail of the sheet which is going to be printed (using suitable acceleration devices, such as, for example, a series of sucker rollers placed below the feed table) after the said sheet has been grasped by the grippers of the printing cylinder, making them form a pocket underneath the said cylinder. The tail of the sheet, however, after having been left by the acceleration devices, hangs free, and is thus able to come into contact with the neighbouring surfaces.

Such a solution is not acceptable owing to the serious danger of spoiling the sheet and damaging printing which may previously have been done, especially in fast and large size machines.

A main object of this invention is the avoidance of the difficulties, shortcomings and the disadvantages which are mentioned above.

SUMMARY OF THE INVENTION

According to the invention there is provided a rotary printing press for single sheets of the type comprising a feeder table on to which the sheets are fed partly overlapping and on which the sheets are set in register frontally and laterally, means for transferring the sheets from the feeder table to a transfer drum rotating at an angular velocity which varies periodically with a period which corresponds to the time taken by the printing cylinder, or by the first of the printing cylinders of the press, rotating at a constant velocity, to make one complete revolution, and means for transferring the sheets from the transfer drum to the said printing cylinder, characterised in that means are provided for imparting to the transfer drum a peripheral velocity which varies from a minimum value substantially equal to the constant peripheral velocity of the printing cylinder, in such manner that the transfer drum, the diameter of which exceeds that of the printing cylinder, accelerates the sheet after leaving the feeder table up to a velocity which is higher than the peripheral velocity of the printing cylinder and then slows the sheet down to the peripheral velocity of the printing cylinder, and passes the sheet to the said printing cylinder so that the leading edge of the sheet transferred to the printing cylinder follows closely the tail edge of the sheet which preceded it, making possible a reduction of the non-print angle of the printing cylinder and, in consequence, a reduction in the diameter of the said cylinder, for the printing sheets of a given maximum format.

This invention makes it possible to advance the disengagement of the register setters from the tail of the sheet about to be printed, so as considerably to increase that portion of stopping time of the next sheet which can be used for the checking, and the frontal and lateral setting in register of the sheet by conventional means which, thanks to the said increase in the utilizable stopping time, are acceptable even at high production speeds, without adversely affecting the quality of printing.

Moreover, if an adequate length of the feeder trajectory is chosen, it can be so arranged that the sheet, even during its final deceleration stage down to the peripheral velocity of the printing cylinder, when it travels at a velocity always higher than that of the printing cylinder, will reduce the distance of its leading edge from the tail edge of the immediately preceding printed sheet until it reduces this distance to zero. It therefore becomes possible, by this invention, to reduce the diameter of the printing cylinder to a magnitude such that practically the whole periphery of the cylinder can operate as a printing arc, except for a restricted area which is necessary for gripping the sheet. This latter area may be very small if, in order to carry the sheet along, either on the feeder drum or on the printing cylinder, there are used, in a known manner, pneumatic sucker means instead of mechanical means comprising grippers. The peripheral length of the printing cylinder could therefore become, finally, substantially equal to (in practice a little more than), the length of the greatest format of the sheet to be printed.

BRIEF DESCRIPTION OF THE DRAWINGS

Further characteristics and advantages of the invention will become apparent from the following detailed description, given by way of non-restrictive example, of a rotary bicolour offset printing press for sheets, with reference to the accompanying drawings, in which:

FIG. 2 is a detailed side elevation on an enlarged scale of a part of the press shown in FIG. 1;

FIG. 3 is a plan view of the part shown in FIG. 2;

DETAILED DESCRIPTION OF THE ILLUSTRATED EMBODIMENTS

Figure 1:
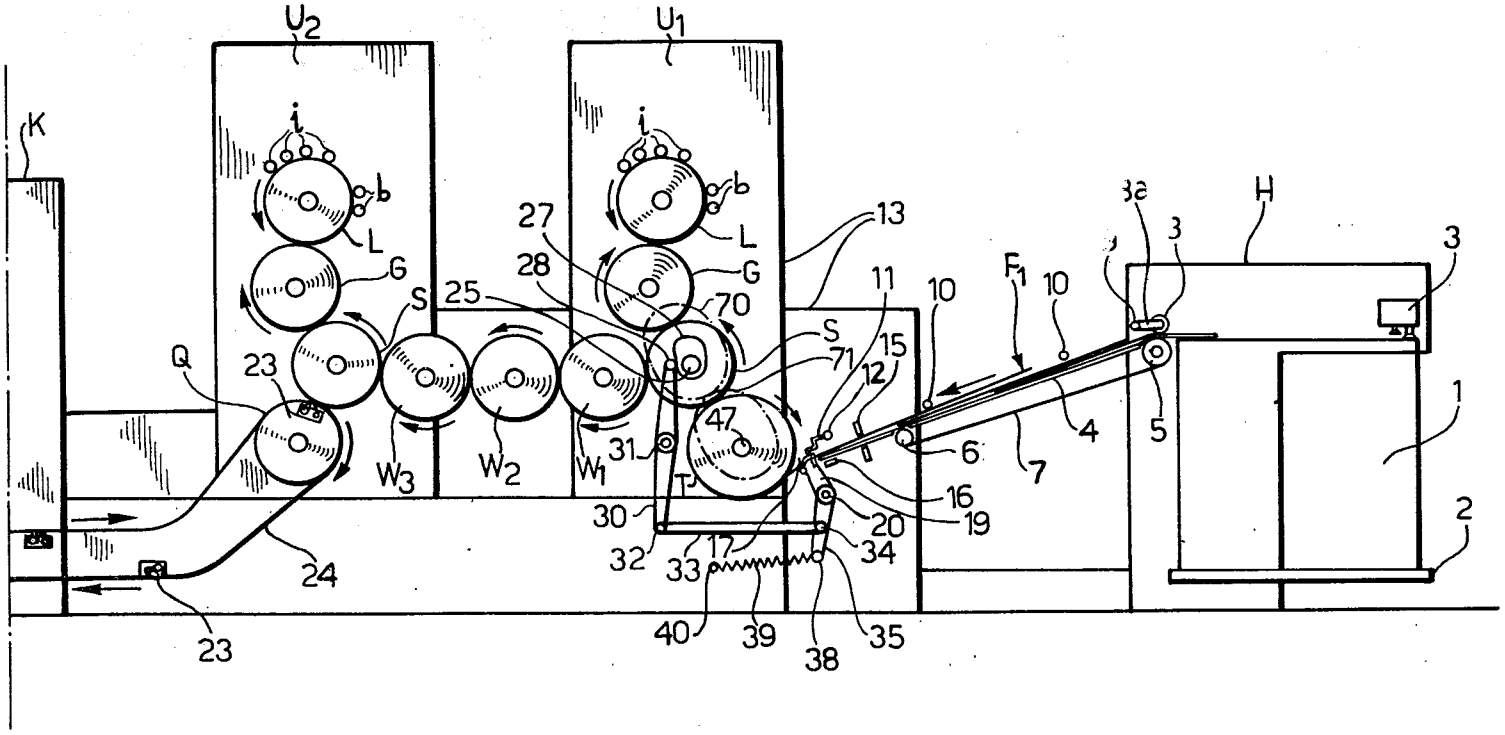
FIG. 1 is a diagrammatic side elevational view of the said press, according to one embodiment of the invention.

In the rotary press of FIG. 1 reference H indicates an automatic sheet feeder system, $U_1$ and $U_2$ two successive printing units each of which prints a different colour, and K a system which collects the delivered sheets. In rotary printing presses of this type there can be, in succession, six or more printing units U for printing different colours on a sheet in a single passage of the sheet through the press. A pile 1 of sheets to be printed is carried upon a table 2, and a sheet separating device 3 is located above the table 2, the device 3 having feeding suckers for rear take-off, that is, suckers which feed the sheets F so that they travel in partial overlapping relation along a feeder table 4.

Feeding of the sheets along the feeder table 4 is effected by endless conveyor belts 7, driven by a roller 5 and supported by an idle roller 6. Sheet feed rolls 8 are carried by arms 8a affixed to a shaft 9 and these are lowered at intervals by means of a drive device (not illustrated) on to the roller 5 upon the arrival of each sheet fed in by the separating device 3. A series of counter rolls 10 maintains the sheets F on the belts 7, so that they travel downwardly along the belts at the same velocity as the latter. The drive transmitted to the belts 7 may be of constant velocity, but more often it will be a periodically variable velocity, so synchronised as to reach a minimum value when each sheet, guided by the belts, comes to rest against a series of front registers 11 of the conventional type, carried upon a shaft 12 which rotates between end supports housed in side walls 13 and 14 of the frame of the machine. The shaft 12 is so driven as to cause the registers 11 to be raised and lowered intermittently. In the example illustrated, the registers 11 and the shaft 12 are placed above the feeder table 4, but in other embodiments the registers 11 and shaft 12 may be disposed below the table 4.

In the position shown in FIG. 1 the registers 11 are lowered and in contact with the front edge of the first sheet, $F_1$, which is held flat against the table 4 by counter-register surfaces 11a. In this position a lateral alignment device 15 consisting of a lower driving roller 15b and an upper restraining roller 15a, puts the sheet, in a known manner, into lateral register, displacing it along gently, by friction, in a lateral direction against a stop 15c (FIG. 3) which acts as a lateral register. In this position control devices 16 for detecting the presence of a lateral edge of the sheet, of known type, such as, for example, photoelectric cells, are prearranged to provide a signal in the event of failure of a sheet to arrive at the setting registers or irregular arrival of the sheets at the said registers, the devices 16 being arranged to initiate operation automatically of known safety devices (not illustrated) in response to such a signal.

The sheet $F_1$ is thus set, by the front registers 11, the lateral alignment device 15 and the control devices 16, in both frontal and lateral register and checked preparatory to being fed to the printing members.

The feeding of the sheet to the printing members is effected by a number of lever grippers 17 pivotally mounted on a shaft 41. When these grippers closed, by a known mechanism, on to cooperating abutments 18a carried by a rod 18, they grip the sheet, which is then released from the registers 11 by a rotation of the shaft 12. The shaft 41 is rotatably supported, and the rod 18 is rigidly fixed, at the free ends of a plurality of arms 19 the opposite ends of which are attached by taper pins 37 to a shaft 20 which is journalled at its ends in the side walls 13 and 14.

The lever grippers 17 are driven, in the example illustrated, from the printing cylinder S of the first printing unit $U_1$. The cylinder S has a shaft 25 on which there is mounted a cam 26 having a profile 27 which acts upon a cam follower roller 28. The roller 28 is rotatably mounted on a pin 29 carried at one end of a rocking lever 30 which free to rock about a pin 31 fixed to the side wall 14. On to the opposite end of the lever 30 there is articulated, by means of a pin 32, one end of a tie rod 33 the other end of which is articulated to a pin 34 attached to a lever 35. The lever 35 is fixed at one end by means of a cotter pin 36 to the shaft 20 which carries the arms 19 supporting the lever grippers 17, and the other end of the lever 35 carries a stud 38 to which one end of a tension spring 39 is attached, the other end of the spring 39 being anchored to a stud 40 attached to the side wall 14. The spring 39 serves the double purpose of constantly biasing the roller 28 to follow the profile 27 of the cam 26, and to prevent inversion of the end play in the drive transmission of the lever grippers, such inversion tending to occur in response to alternating inertia forces during the oscillating movement and being exceedingly harmful to the precision of the print setting.

The drive transmitted to the lever grippers 17 is such that they remain stationary and open against the feeder table 4 for the whole time in which the roller 28 is on the minimum radius of the cam profile 27. At the end of this stationary period the grippers 17, after closing on to the abutments 18a to grip the sheet $F_1$ which has been previously set in register on the table 4, commence movement (point A of FIG. 5) away from the table 4, as the roller 28 passes over the ascending portion of the cam profile 27 of progressively increasing radius. when the roller 28 is about half-way up the ascending portion of the cam profile 27 the grippers 17 reach a point of tangency (point B) with a drum T rotating at periodically variable velocity, and at this point the grippers 17 open so as to give up the sheet to grippers 21 on the said drum T, which close at the same instant. This situation is illustrated in FIGS. 2 and 3.

The lever grippers 17 complete their oscillation until they reach a dead centre position, from which, after a short dwell, they effect a reverse movement so as to return to the feeder table 4 and stop, open, against the said table 4.

The drum T (FIGS. 2 and 3), which takes the sheet from the lever grippers 17, comprises a rotatable shaft 47 supported at its ends by the side walls 13 and 14 and two end discs 48 and 49 secured to the shaft 47 by means of taper pins 50 and 51 respectively. Discs 52 are also mounted on the shaft 47 to support the sheet. Each of the discs 52 is slidable along the shaft 47, but is not free to rotate around the shaft 47. For this purpose the hub 53 of each disc 52 has, upon the internal surface of its through bore, an axially extending groove in which a key 54 fixed to the shaft 47 engages. Corresponding with the said notch each hub 53 also has a radially extending threaded hole in which a locking screw 55 engages for locking the disc 52 at a desired axial position on the shaft 47 selected so as to avoid the line of contact of the disc 52 with the sheet coinciding with a newly printed area on the sheet. A rod 56, affixed to the end discs 48 and 49, carries abutments 57 against which the grippers 21 bear when closed to grip the sheet. The grippers 21 themselves are carried by a rotatable shaft 58 supported at its ends by the discs 48 and 49. To one end of the shaft 58 there is also affixed, by means of a taper pin 59, a lever 60 carrying a pin 61 upon which a roller 62 is rotatably mounted. The pin 61 also affords an anchorage for one end of a tension spring 66 the other end of which is attached to a pin 65 fixed to the disc 49. When the drum T is rotating, the roller 62 is constantly urged by the spring 66 against the profile of a shaped cam 67 fixed to the side wall 13 by means of screws 68. The profile of the cam 67 is so formed and placed as to close the grippers 21 at point B (FIGS. 4–5) at which point the grippers 21 take the sheet $F_1$ from the lever grippers 17.

Next, the sheet $F_1$ is in a similar manner transferred by the grippers 21 of the drum T to grippers 22 on the printing cylinder S of the first printing unit at a point C of contact between the drum T and the cylinder S. The drive system of the grippers 22 of the cylinder S is identical to that of the grippers 21 and hence it is not illustrated.

Figure 4:
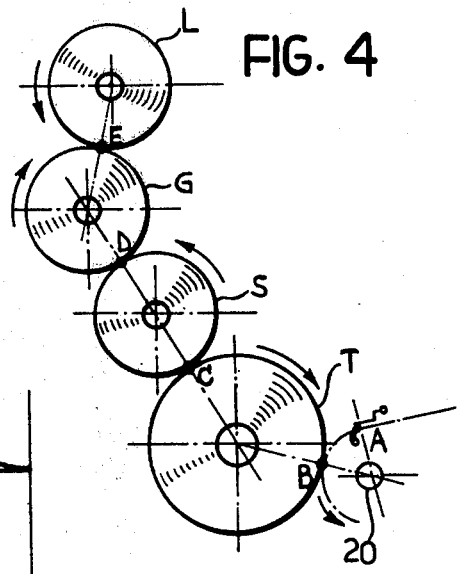
FIG. 4 is a simplified side elevation of another part of the press shown in FIG. 1.

The sheet $F_1$ taken up at point C by the printing cylinder S, is carried to be printed at a point D of contact between the cylinder S and a cylinder G, having, in offset rotary printing presses, an intermediate function. The cylinder G is in fact covered with rubber and is therefore able to receive an ink impression from a printing plate carried by a cylinder L having wetting rolls b and inking rolls i. The image to be printed is thus transferred, at the point E, from the printing plate on the cylinder L, on the covering of the cylinder G, and is then printed by the cylinder G at point D on to the sheet $F_1$ which is carried upon the printing cylinder S (FIGS. 1 and 4).

From the printing cylinder S the sheet $F_1$, printed, is transferred by the transfer mechanism similar to that already described, over a series of transfer rollers $W_1$, $W_2$ and $W_3$, to the printing cylinder S of the second printing unit $U_2$. The drums and cylinders referred to above all rotate at a constant angular velocity, with the exception of the first drum T the angular velocity of which is varied periodically. In the example illustrated there are two printing units $U_1$ and $U_2$, but in practice further similar printing units could follow the unit $U_1$ if more than two colours are to be printed.

From the printing cylinder S of the second unit $U_2$, or the last printing unit where there are more than two such units, the sheet is transferred to gripper rods 23 supported at opposite ends, as known per se, by a pair of endless chains 24 wound on to a take-off drum Q. The chains 24 are wound on the drum Q so that at each turn of the printing cylinder S, or for each sheet printed, one of the gripper rods 23 is located at the point of common tangency between the cylinder S and the drum Q. The gripper rods 23 convey each sheet to a pile, not illustrated, on which the sheet is deposited, this pile being formed in a unit K.

As will be apparent from the preceding description, the lever grippers 17 and the drum T are driven at cyclically variable velocity and the cylinder S rotates at constant velocity. However, at the points B and C at which the sheet $F_1$ passes respectively from the lever grippers 17 to the drum T and from the drum T to the printing cylinder S, it is obviously absolutely necessary that the members which are exchanging the sheet should have equal peripheral velocity. This situation is shown in FIG. 5 in which there are represented graphically the velocities of the lever grippers ($V_p$) and the drum T ($V_T$) and the constant velocity $V_S$ of the printing cylinder S.

It will be seen that in the section QA, corresponding to the period during which the roller 28 rests on the minimum radius portion of the cam 26, the grippers 17 are stationary and in contact with the feeder table 4; at A they close, gripping the sheet, and move away from the table 4 at progressively increasing speed. Equality of the velocities $V_P$ and $V_T$ and the tangency at point B of the respective graphs permit exchange of the sheet between the lever grippers 17 and the drum T. The grippers 17, having thus released the sheet, continue their movement, slowing down progressively until coming to a halt at P corresponding with the position in which the roller 28 is resting upon the maximum radius of the cam profile 27. Subsequently, from R onwards, the grippers 17 reverse their motion in correspondence with the descending portion of the cam profile 27, until again coming to a halt at Q in contact with the feeder table 4. At the same time the sheet taken up at B by the drum T, is accelerated by the latter to the maximum velocity M and thereafter slowed down until it reaches at C a velocity equal to the constant velocity $V_S$ of the printing cylinder S. At C, since $V_T$ is tangential to $V_S$, transfer of the sheet from the drum T to the cylinder S can take place.

It will be apparent from the preceding description that the sheet to be printed, starting from rest at point A, is accelerated progressively until reaching, at point X, the velocity $V_S$ of the printing cylinder S. From this moment onwards, the sheet always has a velocity greater than $V_S$, and can thus recover the lag or distance lost relative to the cylinder S in the previous period represented by the interval NX. Since the areas beneath the various graphs in FIG. 5 are proportional to the distances covered, it can be concluded that the distance by which the first sheet to be printed lags behind the periphery of the printing cylinder S at the end of the interval NX is represented by the area enclosed by the letters NZAX, whilst the distance which the sheet subsequently gains relative to the printing cylinder S is represented by the area enclosed by the letters XBMC (shown cross-hatched). It is therefore sufficient to arrange that these two areas are equal to each other in order to ensure that at the moment at which the tail edge of the previously printed sheet passes the point C the leading edge of the next sheet to be printed arrives. That is to say, that non-printing arc of the printing cylinder S, represented by $\alpha$ in FIG. 2, is effectively reduced to zero.

Figure 5:
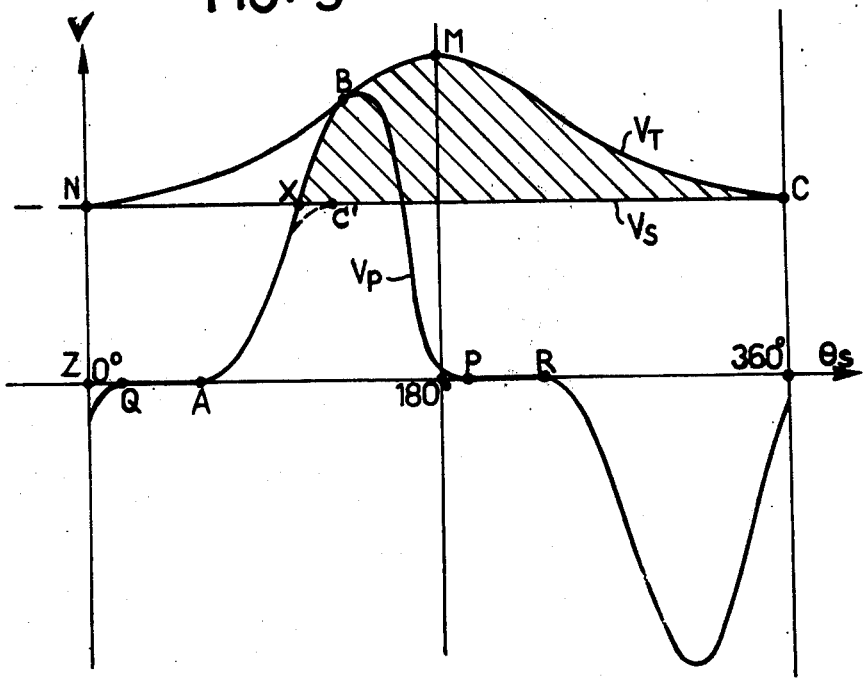
FIG. 5 shows graphs of different peripheral velocities, including the velocity $V_p$ of the lever grippers, $V_S$ of the printing cylinder S, and $V_T$ of the transfer drum T of the press according to the invention.

In FIG. 5 there is also shown in dashed outline the first section of the graph relating to the velocity $V_P$ of the lever grippers in known presses. In these presses the velocity of the drum T is constant, and is equal to that of the printing cylinder S: the lever grippers thus confine themselves to speeding up the sheet until it reaches the speed of the drum at point C′ at which the transfer of the sheet takes place. With this arrangement, since the sheet to be printed never exceeds the speed of the printing cylinder S, the distance lost, in this case represented by the area NZAC′, can in no way be made up.

Figure 6:
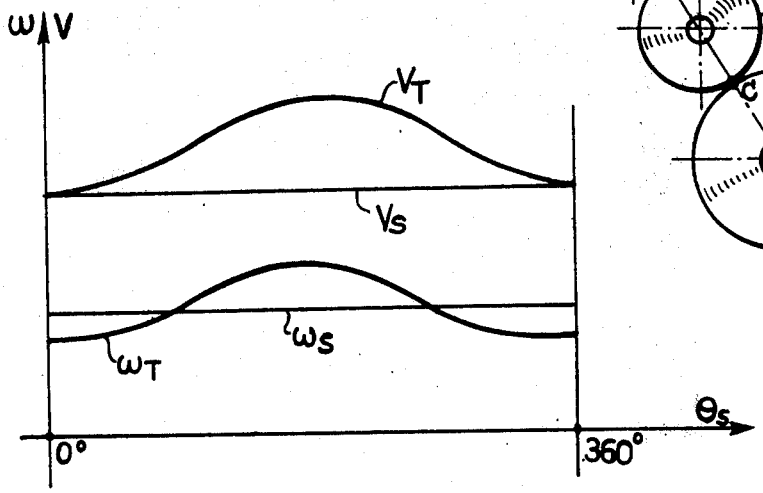
FIG. 6 is a graphical comparison between the peripheral and angular velocities of the drum T and the cylinder S of the press.

The drive of the drum T at a periodically varying velocity as illustrated in the graphs of FIGS. 5 and 6 can be achieved, according to a first embodiment illustrated in FIGS. 2 and 3, by means of a pair of meshing elliptical gears 70 and 71. The elliptical gear 70, which is the driving gear, is fixed to the shaft 25 of the printing cylinder S by means of a taper pin 72, and thus rotates with a constant angular velocity, completing one revolution upon each revolution of the cylinder S, that is one revolution for every sheet printed. The elliptical gear 71, which is the driven gear, also makes one revolution for each sheet printed, but at a periodically varying angular velocity. The gear 71 is fixed to the shaft 47 of the drum T by means of a taper pin 73. The geometrical properties of the ellipse allow the two meshing elliptical gears 70 and 71 which are identical to each other and each rotatable about a focus, to rotate with a constant distance between their axes of rotation, so that the teeth of the gears 70 and 71 remain engaged without play.

The angular velocity of the driven elliptical gear 71 varies periodically, from a minimum to a maximum value, around a mean value equal to the constant angular velocity of the driving elliptical gear 70. The ratio between the minimum and maximum rotational speeds of the driven gear 71 depends upon the eccentricity of the two elliptical gears.

FIG. 6 shows graphically the constant angular velocity $\omega_S$ of the printing cylinder S and the angular velocity $\omega_T$ of the drum T; since each revolution of the printing cylinder S corresponds to a complete revolution of the drum T, the areas under the two graphs, being proportional to their respective angular displacements, will be equal to each other. The peripheral velocities of the cylinder S and of the drum T are respectively $V_S = \omega_S \cdot R_S$ and $V_T = \omega_T \cdot R_T$, $R_S$ and $R_T$ being the radii of the cylinder S and of the drum T respectively. By appropriate selection of the ratio $R_T/R_S$ it is thus possible to achieve the condition under which at point C (FIGS. 5 and 6) the peripheral velocities $V_S$ and $V_T$ are substantially equal clearly for this condition $R_T > R_S$.

Figure 7:
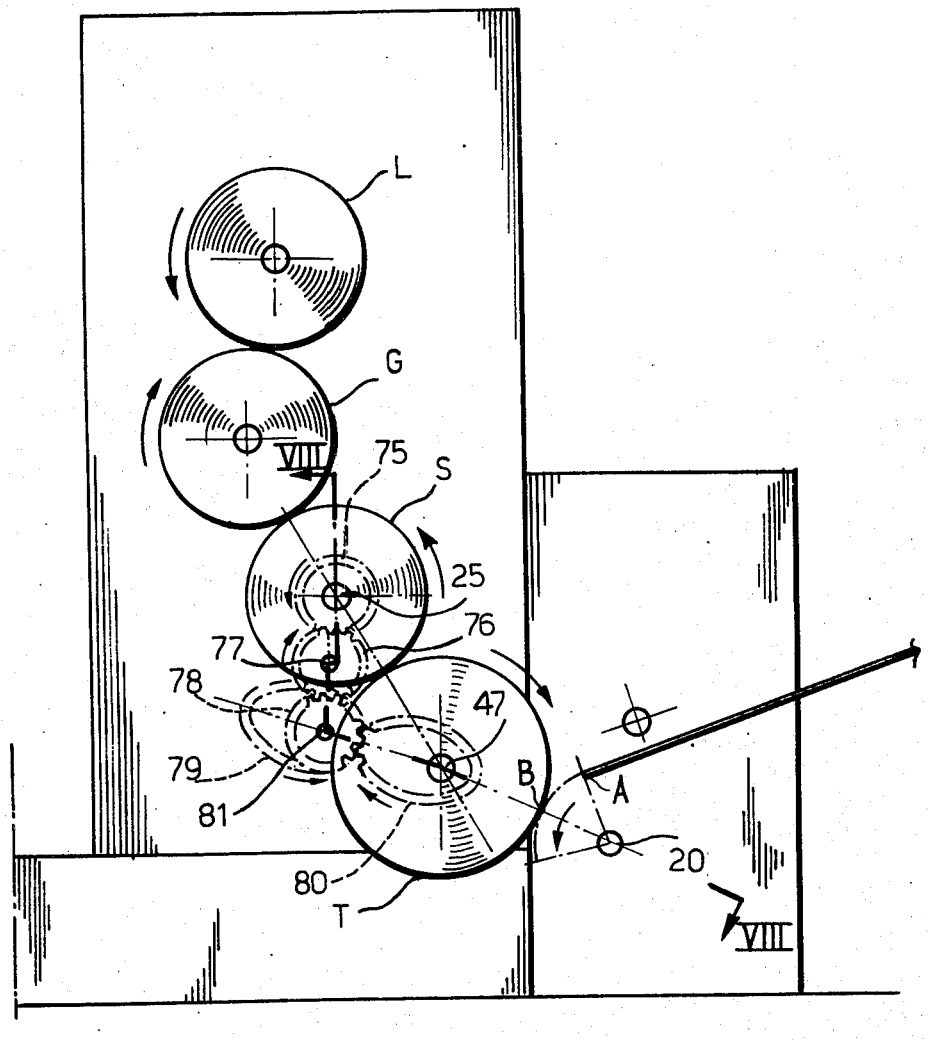
FIG. 7 is a diagrammatic side elevational view of a variant of the part of the press shown in FIG. 2.
Figure 8:
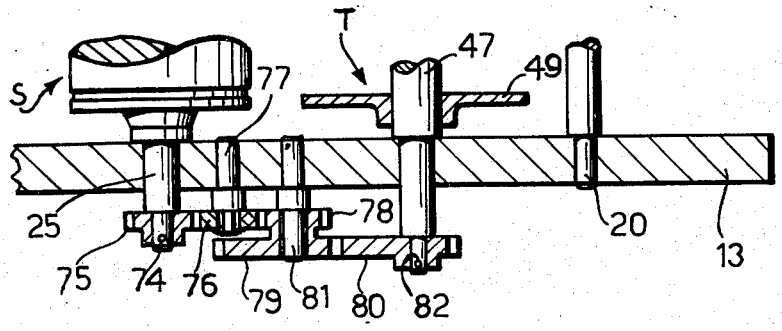
FIG. 8 is a plan view of the variant shown in FIG. 7.

In presses intended for printing sheets of a large format, the use of a drive transmission for the drum T having elliptical gears, as illustrated in FIGS. 2 and 3, in which the driving gear is attached directly to the printing cylinder S and the driven gear is attached directly to the drum T, would recessitate using pairs of elliptical gears of considerable dimensions. In this case it is therefore preferable to adopt the variant illustrated in FIGS. 7 and 8 in which there is attached to the shaft 25 of the printing cylinder S, by means of a taper pin 74, a cylindrical gear 75 which drives with a 1:1 ratio, through an intermediate gear 76 mounted idly upon a shaft 77, a cylindrical gear 78 fixed to an elliptical driving gear 79 which is idly mounted upon a shaft 81. The shafts 77 and 81 are both supported in cantilever-fashion by the side wall 13. In this way it is arranged that the driving gear 79 makes one complete rotation for each sheet printed, and drives, with a cyclically varying speed, a driven elliptical gear 80 which is affixed, by means of a taper pin 82, to the shaft 47 of the drum T. If therefore one selects for the two elliptical gears 79 and 80 the same eccentricity as was selected for the elliptical gears 70 and 71 in the embodiment of FIGS. 2 and 3, then the speed of the driven elliptical gear 80 will be the same as that of the gear 71 in FIGS. 2 and 3, but the elliptical gears 79 and 80 will be of smaller size.

Figure 9:
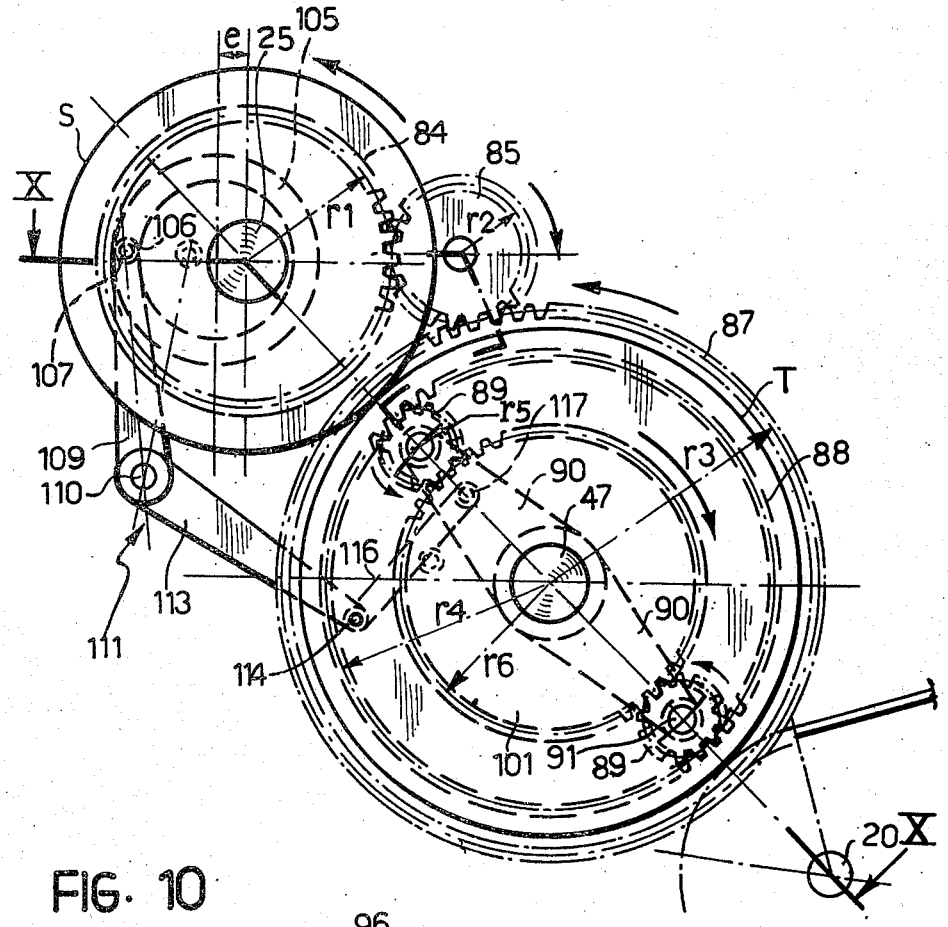
FIG. 9 is the diagrammatic side elevational view of part of a press according to a different embodiment of the invention.
Figure 10:
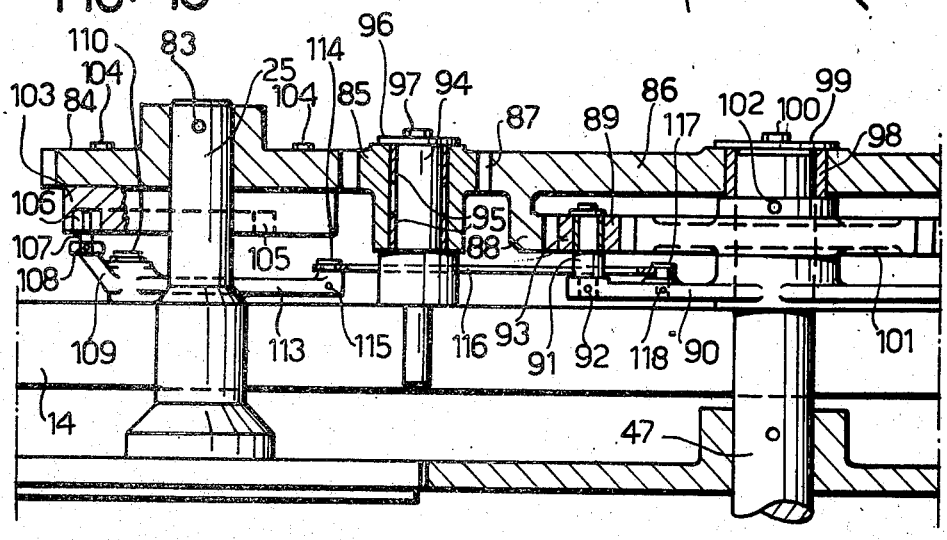
FIG. 10 is a plan view of the part of the press shown in FIG. 9.

In another embodiment, rotation of the drum T at a periodically varying velocity can be achieved by means of a drive taken from the printing cylinder S through an epicyclic gear train in which the planet carrier is moved periodically by a cam. Such an arrangement in FIGS. 9 and 10. In this embodiment the shaft 25 of the printing cylinder S has a cylindrical gear 84 attached thereto by means of a taper pin 83. The cylindrical gear drives, through an intermediate gear 85, a double ring gear 86 having outer gear teeth 87 which are driven by the intermediate gear 85, and inner gear teeth 88 which transmit the drive to two planet wheels 89. The planet wheels 89 are supported by shafts 91 carried on two arms of a planet carrier lever 90, the shafts 91 being fixed to the said lever arms by taper pins 92, and the planet wheels 89 being rotatably mounted on the shafts 91 by means of interposed bushes 93. The intermediate gear 85 is rotatably mounted, with the interposition of a bush 95, on a shaft 94 fixed into the side wall 14 and is retained by a washer 96 secured by a nut 97. The double ring gear 86 is rotatably mounted upon the shaft 47 of the drum T, with the interposition of a bushing 98, and is retained between a washer 99, fixed to the shaft 47 by a nut 100 and one lateral face of the hub of a toothed sun wheel 101. The sun wheel 101 is driven by the planet wheels 89 and transmits drive to the shaft 47 of the drum T to which the wheel 101 is affixed by a taper pin 102. The planet carrier lever 90 is mounted upon the shaft 47 of the drum T, on which it is freely pivotable, and is held axially between the side wall 14 and the other lateral face of the hub of the sun wheel 101. Oscillation of the lever 90 is controlled by a cam 103 affixed to the gear 84 by bolts 104. The cam 103 has in one face a circular groove 105 arranged with an eccentricity "e" relative to the axis of rotation of the printing cylinder S.

The annular cam groove 105 is in this example circular for the sake of simplicity, but it could have any other geometrical shape designed to achieve a periodic movement.

In the cam groove 105 there engages a cam follower roller 106 rotatable upon a pin 107 fixed by means of a taper pin 108, to the extremity of one arm 109 of a bellcrank lever 111 pivoted at a pivot pin 110 screwed to the side wall 14. The other arm 113 of the bellcrank lever 111 carries at its free end a pivot pin 114 fixed to the arm 113 by a taper pin 115. On to this pivot pin 114 is articulated one end of a tie-rod 116 which is articulated at is other end on to a pivot pin 117 fixed by means of a taper pin 118 to one of the two arms of the planet-carrier lever 90. By this means the planet-carrier lever 90 receives a periodic double oscillating movement (an anti-clockwise movement followed by a clockwise movement when starting from the position illustrated in FIG. 9) upon each complete rotation of the cylinder S which carries the drive cam 103.

The drive ratio of the said cylindrical gears 84, 85 is so chosen that, by keeping the planet-carrier lever fixed, the toothed wheel 101 fixed to the drum T executes one revolution for each revolution of the cylindrical gear 84 fixed to the cylinder S, that is, that the overall drive ratio $\tau = \omega_T/\omega_S$, between the angular velocities of the drum T and the cylinder S, is equal to 1. Given that $r_1$, $r_2$, $r_3$, $r_4$, $r_5$, and $r_6$ are respectively, the pitch radii of the gears 84, 85, 87, 88, 89 and 101 then this condition applies it:

$$\tau = \frac{W_T}{W_S} = \frac{r_1}{r_2} \times \frac{r_2}{r_3} \times \frac{r_4}{r_5} \times \frac{r_5}{r_6} = 1$$

As will be seen from the example previously described the increased diameter of the transfer drum T makes it possible to impose upon the sheet, in its travel on the drum, a velocity which is always greater than the peripheral velocity, equal to that of the printing velocity, of the printing cylinder S; in this way one avoids loss of working time due to the arrest of the sheet to be printed on the feeder table 4, necessary for effecting registration, while at the same time the lag distance between the sheet and the preceding sheet during this time can be made up allowing the leading edge of the sheet ao about to be printed to come close to the tail edge of the previously printed sheet, up to the point where the leading edge of the sheet actually reaches the trailing edge of the preceding sheet. Consequently the angle $\alpha$ of non-printing on the cylinder s can be reduced effectively to zero, with a corresponding reduction in the diameter of the said printing cylinder S, and of the other cylinders taking part in the printing (L and G), as well as the cylinders of the next printing unit to which the sheet is passed.

What is claimed is:

1. A rotary printing press for single sheets of the type comprising a rotary printing cylinder, means for driving the printing cylinder at a constant velocity, a feeder table onto which the sheets are fed partly overlapping, means on the feeder table for setting the sheets in register frontally and laterally, a rotary transfer drum having a diameter larger than the diameter of said cylinder, means driving the transfer drum at an angular velocity which varies periodically with a period equal to the time taken by the printing cylinder to make one complete revolution, oscillating transfer means having gripping means for transferring the sheets from the feeder table to the transfer drum and means for transferring the sheets from the transfer drum to said printing cylinder, wherein the improvement comprises elliptical gear means operatively disposed intermediate said printing cylinder and said transfer drum, said elliptical gear means being sized to impart to the transfer drum a peripheral velocity which varies from a minimum value substantially equal to the constant peripheral velocity of the printing cylinder to a maximum velocity which is higher than said minimum value and higher than the peripheral velocity of the printing cylinder, cam means mounted on the axis of said printing cylinder for driving said oscillating transfer means, said cam means being rotationally oriented relative to the printing cylinder such that the transfer means is moved from a stop position adjacent said feeder table, at which time said gripper means picks up a sheet from said feeder table, to a velocity greater than the peripheral velocity of said printing cylinder adjacent to said transfer drum prior to the transfer drum reaching its maximum velocity and additional gripping means on said transfer drum for receiving a sheet from said oscillating transfer means when the velocities of said transfer drum and said oscillating transfer means are equal and means to render said means for transferring the sheets from said transfer drum to said printing cylinder operative when the peripheral velocity of said transfer drum is equal to the peripheral velocity of said printing cylinder.

2. A printing press as set forth in claim 1 wherein the gripping means for transferring the sheets from the feeder table to the transfer drum are comprised of lever grippers adapted to remove each sheet from the feeder table and move each sheet in a trajectory which is tangential at one point to said transfer drum at which point said additional gripping means on said transfer drum are adapted to grip each sheet carried by said lever grippers, and further including drive means for moving said lever grippers in proper timed relation with the rotation of said transfer drum and oscillation of said oscillating transfer means.

3. A printing press as set forth in claim 2 wherein the elliptical gear means for imparting to the transfer drum a periodically varying peripheral velocity comprises a pair of identical elliptical meshing gears each rotatable about one of its foci and including means securing one of said gears to the transfer drum for rotation therewith, a shaft, means for rotating said shaft at a constant angular velocity equal to that of the printing cylinder and means coupling said shaft to the other of said meshing elliptical gears to drive the latter.

4. A printing press as set forth in claim 3 and including plurality of cylindrical meshing gears having an overall transmission ratio of unity drivingly interconnecting said shaft and said elliptical gear driven thereby.

* * * * *